US010160006B2

(12) United States Patent
Kawabe et al.

(10) Patent No.: US 10,160,006 B2
(45) Date of Patent: Dec. 25, 2018

(54) COATING DEVICE AND COATING METHOD

(71) Applicant: HONDA MOTOR CO., LTD., Tokyo (JP)

(72) Inventors: Gaku Kawabe, Tochigi (JP); Shinya Murakami, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 15/437,557

(22) Filed: Feb. 21, 2017

(65) Prior Publication Data

US 2017/0239685 A1 Aug. 24, 2017

(30) Foreign Application Priority Data

Feb. 23, 2016 (JP) ..... 2016-031734

(51) Int. Cl.

| | |
|---|---|
| ***B05D 1/02*** | (2006.01) |
| ***B05B 1/30*** | (2006.01) |
| ***B05B 1/14*** | (2006.01) |
| *B05B 13/04* | (2006.01) |

(52) U.S. Cl.

CPC ..... *B05D 1/02* (2013.01); *B05B 1/14* (2013.01); *B05B 1/30* (2013.01); *B05B 13/0431* (2013.01)

(58) Field of Classification Search

None

See application file for complete search history.

(56) References Cited

U.S. PATENT DOCUMENTS

2010/0304009 A1* 12/2010 Bausen ..... B05B 7/2472 427/8

FOREIGN PATENT DOCUMENTS

| | | |
|---|---|---|
| JP | H08-257466 | 10/1996 |
| JP | 10-24259 | 1/1998 |
| JP | 2014-079697 | 5/2014 |

OTHER PUBLICATIONS

Japanese Office Action dated Aug. 1, 2017, 2 pages.

* cited by examiner

*Primary Examiner* — Nathan T Leong

(74) *Attorney, Agent, or Firm* — Rankin, Hill & Clark LLP

(57) ABSTRACT

The present invention has an object to provide a coating vice which can reduce variation in the amount of discharge in the discharge nozzle group. A coating device 1 includes: a first supply unit 40 and a second supply unit 50 which can supply a viscous material N to the discharge nozzle group 10; and a control portion 100 which stops, at the timing at which a first time zone is switched to a second time zone, the supply in the first supply unit 40, which makes the second supply unit 50 start the supply of the viscous material N to the discharge nozzle group 10 at a second flow rate and which makes, in a second time zone, the first supply unit 40 start the preparation of the viscous material necessary in any one of a third time zone and the subsequent time zones.

4 Claims, 7 Drawing Sheets

COATING DEVICE AND COATING METHOD

This application is based on and claims the benefit of priority from Japanese Patent Application No. 2016-03173, filed on 23 Feb. 2016, the content of which is incorporated herein by reference.

BACKGROUND OF THE INVENTION

Field of the Invention

The present invention relates to a coating device which applies a viscous material, and a coating method using the coating device.

Related Art

Conventionally, in the body of an automobile, a vibration damping member which has vibration-proof and sound-proof functions is arranged in order to, for example, reduce engine transmission sound to the interior of the automobile. For example, the vibration damping member, which is coated with a viscous material, is arranged (formed) within the body of the automobile.

Here, when the shape of a coated region is complicated, it is necessary to apply the viscous material while reciprocating a nozzle with a narrow coating width a plurality of times, with the result that it disadvantageously takes time to perform such a coating operation.

Hence, a coating device is proposed which can perform coating corresponding to a coated region by arranging and aligning a plurality of nozzles, and opening and closing the individual nozzles without reciprocating the nozzles (see, for example, patent document 1).

Patent Document 1: Japanese Unexamined Patent Application, Publication No. H10-24259

SUMMARY OF THE INVENTION

However, in the coating device disclosed in patent document 1, since a viscous material (vibration damping material) is fed from a pump at a constant pressure (flow rate), when the coated region is varied, the amount of discharge (amount of coating) of the viscous material in the nozzle may be varied. In other words, in the coating device disclosed in patent document 1, the amount of discharge of the viscous material in the nozzle may be unstable.

The present invention has an object to provide a coating device which includes a discharge nozzle group formed by arranging and aligning a plurality of discharge nozzles, and which can reduce variation in the amount of discharge in the discharge nozzle group.

A coating device of the present invention includes: a discharge nozzle group (for example, a discharge nozzle group 10 which will be described later) which includes a plurality of discharge nozzles (for example, discharge nozzles 10*a* to 10*j* which will be described later) having open/close valves and in which the discharge nozzles are arranged so as to be aligned; a pipe collection portion (for example, a pipe collection portion 30 which will be described later) which is arranged on the upstream side of a plurality of discharge pipelines (for example, discharge pipelines 20*a* to 20*j* which will be described later) that respectively communicate with the plurality of discharge nozzles forming the discharge nozzle group and in which the pipelines are collected; a plurality of supply units (for example, a first supply unit 40 and a second supply unit 50 which will be described later) which are arranged on the upstream side of the pipe collection portion, and which can supply a viscous material to the discharge nozzle group; and a control portion (for example, a control portion 100 which will be described later) in which when a first time zone, a second time zone, a third time zone and subsequent time zones where the flow rates of the viscous material (for example, a viscous material N which will be described later) discharged from the discharge nozzle group differ from each other are continuous, the control portion makes, in the first time zone, a predetermined supply unit (for example, a first supply unit 40 which will be described later) among the supply units that completes the preparation of the viscous material in the first time zone supply the viscous material to the discharge nozzle group at a first flow rate, stops, at the timing at which the first time zone is switched to the second time zone, the supply in the predetermined supply unit and makes another supply unit (for example, a second supply unit 50 which will be described later) among the supply units that completes the preparation of the viscous material supplied in the second time zone start the supply of the viscous material to the discharge nozzle group at a second flow rate and makes, in the second time zone, the another supply unit supply the viscous material at the second flow rate and makes the predetermined supply unit start the preparation of the viscous material necessary in any one of the third time zone and the subsequent time zones.

In the present invention, at the timing at which the first time zone is switched to the second time zone, the coating device stops the supply of the viscous material at the first flow rate by the predetermined supply unit, and starts the supply of the viscous material at the second flow rate by the another supply unit. In this way, the coating device of the present invention can reduce variation in the amount of discharge of the viscous material at the time of change to a time zone where the flow rate is different. In this way, the coating device of the present invention can reduce variation in the thickness of coating in a portion (for example, a position in which the width is changed) in which the shape of the coated region is changed.

The coating device of the present invention includes a plurality of discharge nozzles having the open/close valves, and includes the discharge nozzle group in which the plurality of discharge nozzles are arranged so as to be aligned. In this way, the coating device of the present invention can coat the coated region with the viscous material without reciprocating the discharge nozzle portion a plurality of times. In this way, the coating device of the present invention can also shorten the time during which the viscous material is applied. In this way, the coating device of the present invention can also enhance the production efficiency.

The coating device of the present invention makes one of the predetermined supply unit and the another supply unit supply the viscous material, and makes the other start (complete) the preparation of the viscous material necessary in the subsequent time zone. In this way, each time the time zone is changed, the coating device of the present invention can use (switch) the predetermined supply unit or the another supply unit which completes the preparation (storage) of the viscous material.

Preferably, in the coating device of the present invention, each of the plurality of supply units includes: a supply portion (for example, a first supply portion 42 and a second supply portion 52 which will be described later) which can supply the viscous material to the discharge nozzle group; and a switch portion (a first switch portion 47 and a second switch portion 57 which will be described later) which is arranged between the supply portion and the pipe collection portion and which can switch between an opened state where the viscous material from the supply portion is supplied to the discharge nozzle group, and a closed state where the viscous material is not supplied to the discharge nozzle group, and the control portion, in the first time zone, makes the supply portion (for example, a first supply portion 42 which will be described later) in the predetermined supply unit, supply the viscous material to the discharge nozzle group at the first flow rate, and brings the switch portion (for example, a first switch portion 47 which will be described later) in the predetermined supply unit into the opened state, with the timing at which the first time zone is switched to the second time zone, makes the supply portion in the predetermined supply unit stop the supply of the viscous material, brings the switch portion in the predetermined supply unit into the closed state, makes the supply portion (for example, a second supply portion 52 which will be described later) in the another supply unit supply the viscous material to the discharge nozzle group at the second flow rate, and brings the switch portion (for example, the second switch portion 57 which will be described later) in the another supply unit into the opened state and in the second time zone, makes the supply portion in the another supply unit supply the viscous material to the discharge nozzle group at the second flow rate, keeps the switch portion in the another supply unit in the opened state, and makes the supply portion in the predetermined supply unit start the preparation of the viscous material necessary in any one of the third time zone and the subsequent time zones.

In the present invention, at the timing at which the first time zone is switched to the second time zone, the coating device makes the supply portion in the predetermined supply unit stop the supply of the viscous material, brings the switch portion in the another supply unit into the closed state, makes the supply portion in the another supply unit supply the viscous material to the discharge nozzle group at the second flow rate, and brings the switch portion in the another supply unit into the opened state. In this way, the coating device of the present invention can suitably reduce variation in the amount of discharge of the viscous material at the time of change to a time zone where the flow rate is different. In this way, the coating device of the present invention can also suitably reduce variation in the thickness of coating in a portion (for example, a position in which the width is changed) in which the shape of the coated region is changed.

Preferably, in the coating device of the present invention, when the amount of variation that is a difference between the flow rate of the viscous material supplied to the discharge nozzle group in a predetermined time zone and the flow rate of the viscous material supplied to the discharge nozzle group in a time zone continuous with the predetermined time zone is less than a predetermined amount, the control portion makes a supply unit that supplies the viscous material in the predetermined time zone supply the viscous material continuously even in the continuous time zone.

When the amount of variation that is a difference between the flow rate of the viscous material supplied to the discharge nozzle group in a predetermined time zone and the flow rate of the viscous material supplied to the discharge nozzle group in a time zone continuous with the predetermined time zone is less than the predetermined amount, the coating device of the present invention makes the supply unit that supplies the viscous material in the predetermined time zone supply the viscous material continuously even in the continuous time zone. In this way, when a small amount of variation in the supply amount of the viscous material caused by the change of the time zones is produced, the coating device of the present invention can continuously make the same supply unit supply the viscous material. In this way, the coating device of the present invention can reduce the excessive switching of the supply units, and thereby can reduce a burden placed on the device.

A coating method of coating a predetermined target with a coating device which includes: a discharge nozzle group which includes a plurality of discharge nozzles having open/close valves, and in which the plurality of discharge nozzles are arranged so as to be aligned; a pipe collection portion which is arranged on the upstream side of a plurality of discharge pipelines that respectively communicate with the plurality of discharge nozzles forming the discharge nozzle group, and in which the plurality of pipelines are collected; and a plurality of supply units which are arranged on the upstream side of the pipe collection portion, and which can supply a viscous material to the discharge nozzle group, the coating method including: a first coating step (for example, a first coating step K1 which will be described later) of making a predetermined supply unit among the plurality of supply units that completes the supply preparation of the viscous material supply the viscous material to the discharge nozzle group at a first flow rate; a switch step (for example, a first switching step R1 which will be described later) of stopping, at the timing at which the first coating step is switched to a second coating step (for example, a second coating step K2 which will be described later) continuous with the first coating step, the supply in the predetermined supply unit, and making another supply unit among the plurality of supply units that completes the preparation of the viscous material supplied in the second coating step start the supply of the viscous material to the discharge nozzle group at a second flow rate different from the first flow rate; and the second coating step of making the another supply unit supply the viscous material at the second flow rate and making the predetermined supply unit start the preparation of the viscous material necessary in any one of a third coating step continuous with the second coating step and subsequent coating steps (for example, a third coating step K3 to a sixth coating step K6 which will be described later).

In the present invention, at the timing at which the first coating step is switched to the second coating step, the coating device stops the supply of the viscous material at the first flow rate by the predetermined supply unit, and starts the supply of the viscous material at the second flow rate by the another supply unit. In this way, the present coating method can reduce variation in the amount of discharge of the viscous material at the time of change to a coating step where the flow rate is different. In this way, the present coating method can reduce variation in the thickness of coating in a portion (for example, a position in which the width is changed) in which the shape of the coated region is changed.

In the present invention, with the coating device including a plurality of discharge nozzles having the open/close valves and the discharge nozzle group in which the plurality of discharge nozzles are arranged so as to be aligned, the viscous material is applied. In this way, in the present coating method, it is possible to coat the coated region with the viscous material without reciprocating the discharge nozzle portion a plurality of times. In this way, in the present coating method, it is also possible to shorten the time during which the viscous material is applied. In this way, in the present coating method, it is also possible to enhance the production efficiency.

In the present invention, the coating device makes one of the predetermined supply unit and the another supply unit supply the viscous material, and makes the other start (complete) the preparation of the viscous material necessary in the subsequent time zone (coating step). In this way, in the present coating method, each time the coating step is changed, the coating device can use (switch) the predetermined supply unit or the another supply unit which completes the preparation (storage) of the viscous material.

In the present invention, it is possible to provide a coating device which includes a discharge nozzle group formed by arranging and aligning a plurality of discharge nozzles and which can reduce variation in the amount of discharge in the discharge nozzle group.

DETAILED DESCRIPTION OF THE INVENTION

A first embodiment of the present invention will be described in detail below with reference to drawings.

Figure 1:
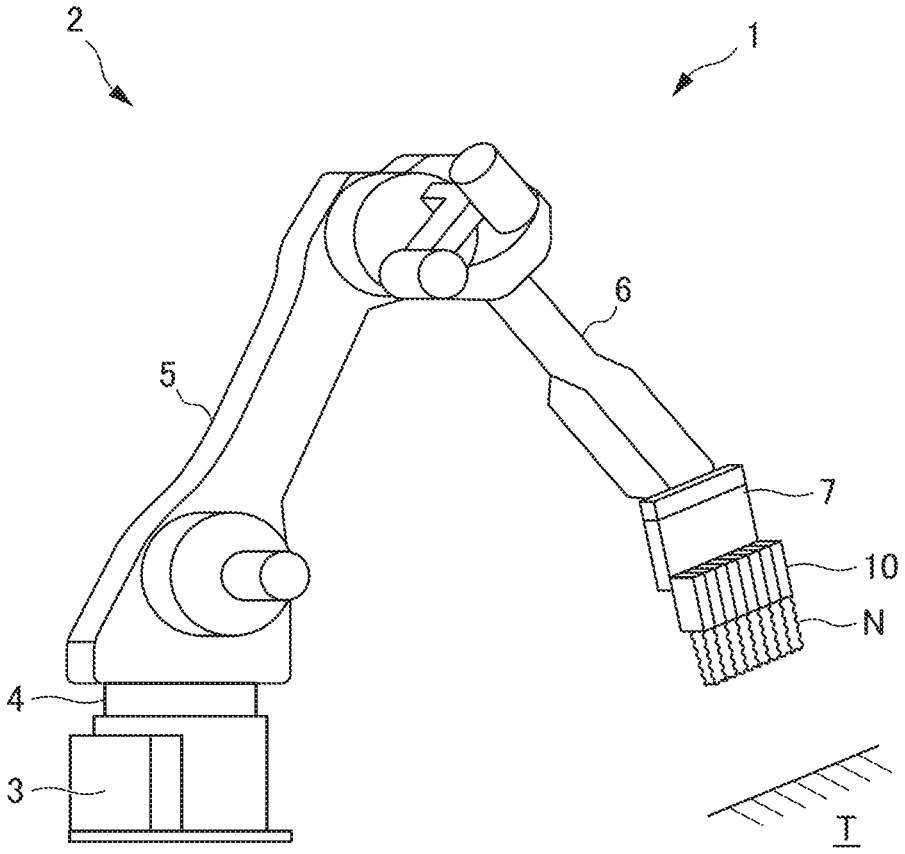
FIG. 1 is a diagram showing the appearance of a coating device according to an embodiment of the present invention.
Figure 2:
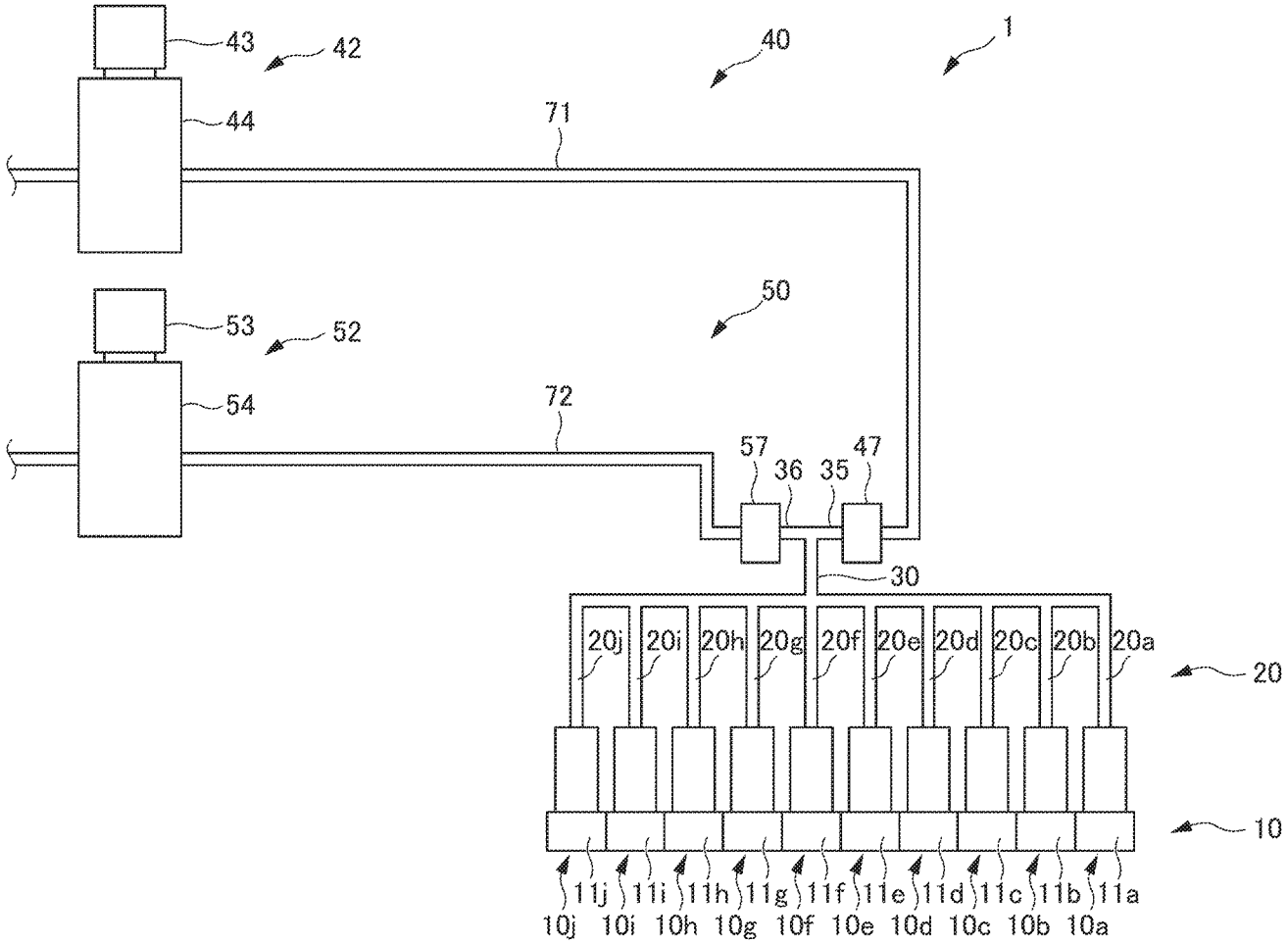
FIG. 2 is a diagram showing the configuration of the coating device according to the embodiment of the present invention.
Figure 3:
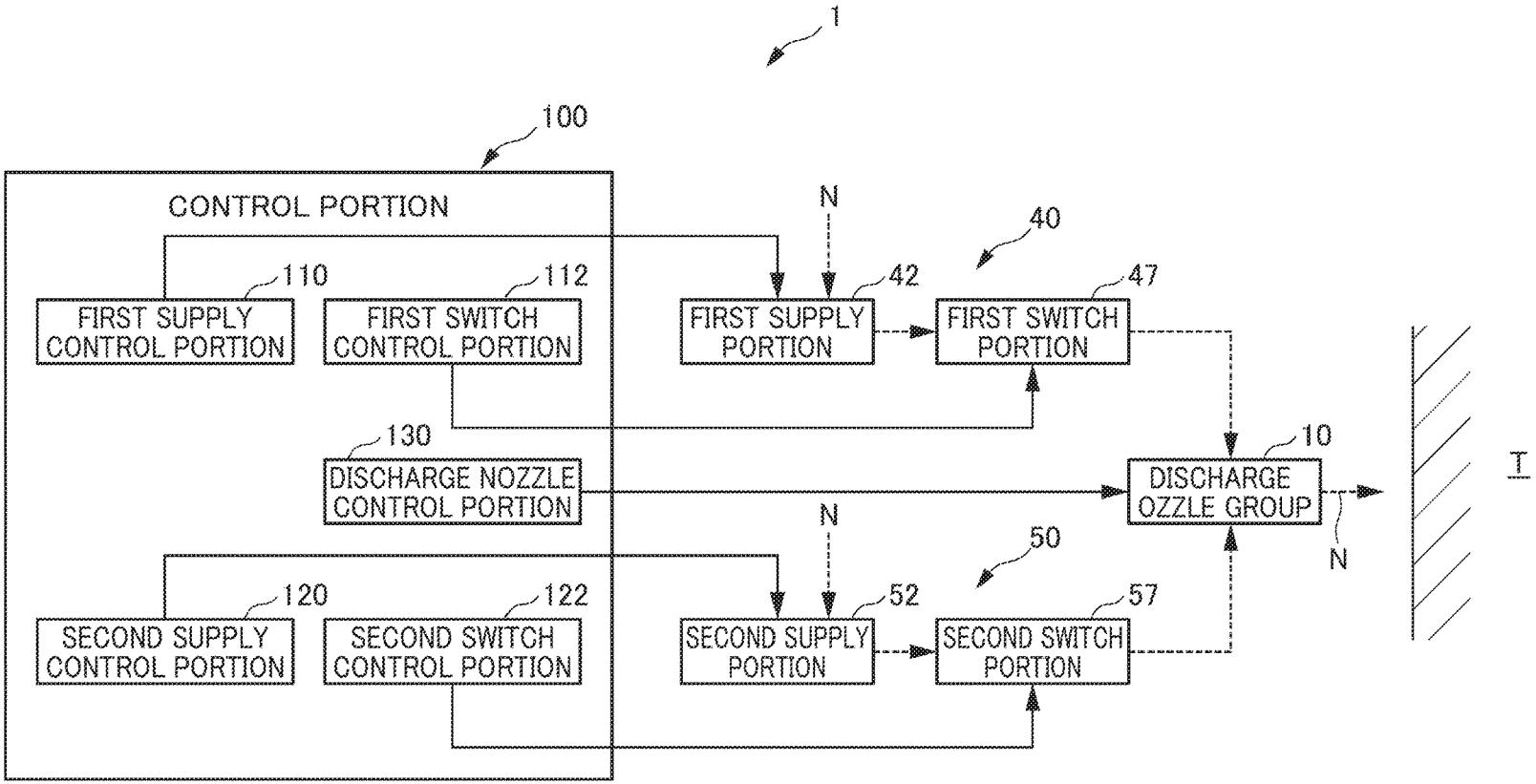
FIG. 3 is a control block diagram of the coating device according to the embodiment of the present invention.
Figure 4A:
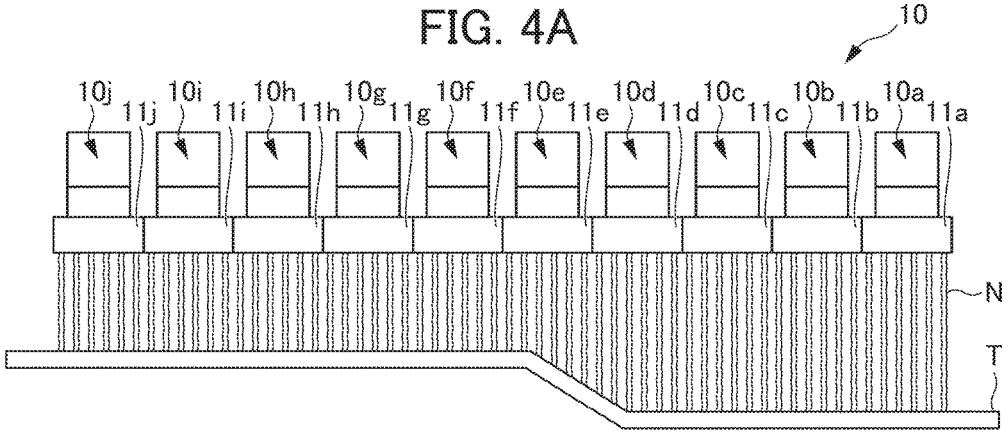
FIG. 4(*a*) is a diagram showing an example of a discharge state in a first time zone, FIG. 4(*b*) is a diagram showing an example of a discharge state in a second time zone and FIG. 4(*c*) is a diagram showing an example of a discharge state in a third time zone.
Figure 4B:
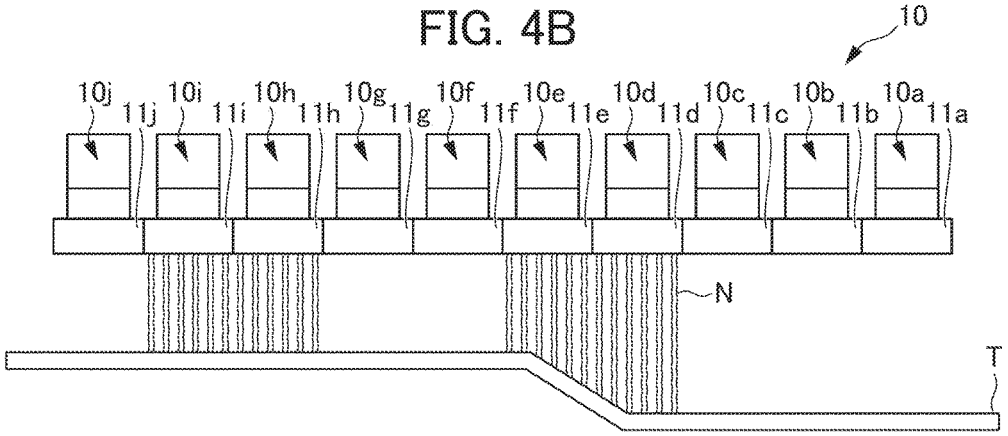
Figure 4C:
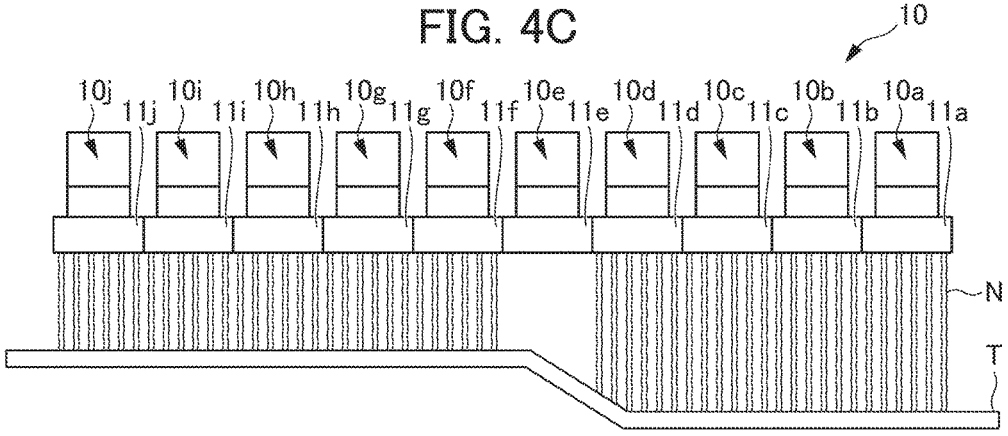

A coating device 1 in the embodiment will first be described with reference to FIGS. 1 to 4. FIG. 1 is a diagram showing the appearance of the coating device according to the embodiment of the present invention. FIG. 2 is a diagram showing the configuration of the coating device according to the embodiment of the present invention. FIG. 3 is a control block diagram of the coating device according to the embodiment of the present invention. FIG. 4(*a*) is a diagram showing a discharge state in a first time zone, FIG. 4(*b*) is a diagram showing a discharge state in a second time zone and FIG. 4(*c*) is a diagram showing a discharge state in a third time zone.

As shown in FIG. 1, the coating device 1 in the present embodiment is a device which coats a target T (for example, the body of an automobile) with a viscous material N (for example, a vibration damping material). In the present embodiment, the coating device 1 has an articulated robot 2. The articulated robot 2 includes a base portion 3, a pivot portion 4 which is provided on an upper surface side of the base portion 3, a first arm 5 which is pivotally coupled through the pivot portion 4 to the base portion 3, a second arm 6 which is coupled to the first arm 5 through a joint portion and a tip end portion 7 which is coupled to the second arm 6 through a joint portion. A discharge nozzle group 10 which will be described later is attached to the tip end portion 7.

As shown in FIGS. 2 and 3, the coating device 1 includes the discharge nozzle group 10, a discharge pipeline group 20, a pipe collection portion 30, a first supply unit 40, a second supply unit 50 and a control portion 100.

As shown in FIG. 2, the discharge nozzle group 10 is arranged, as described above, in the tip end portion 7 of the articulated robot 2. The discharge nozzle group 10 is a portion which discharges the viscous material N to the target T. The discharge nozzle group 10 is a portion which discharges the viscous material N supplied from the first supply unit 40 or the second supply unit 50.

The discharge nozzle group 10 includes a plurality of discharge nozzles 10*a* to 10*j* which have open/close valves 11*a* to 11*j*, respectively. The plurality of discharge nozzles 10*a* to 10*j* are arranged so as to be aligned. The plurality of discharge nozzles 10*a* to 10*j* are arranged so as to be aligned in a direction perpendicular to a direction in which the discharge nozzle group 10 is moved.

As described above, the plurality of discharge nozzles 10*a* to 10*j* have the open/close valves 11*a* to 11*j*, respectively. The plurality of discharge nozzles 10*a* to 10*j* individually can or cannot discharge the viscous material N by the opening and closing of the open/close valves 11*a* to 11*j* (see, for example, FIG. 4). In this way, the discharge nozzle group 10 can discharge the viscous material N according to the shape of a coated region.

The opening and closing of the open/close valves 11*a* to 11*j* are individually controlled by the control portion 100 which will be described later. Each of the open/close valves 11*a* to 11*j* have, for example, an electromagnetic valve (not shown). The open/close valves 11*a* to 11*j* are individually brought into a state where the viscous material N is discharged or a state where the viscous material N is not discharged by the control of the opening and closing of the electromagnetic valve with the control portion 100.

As shown in FIG. 2, the discharge pipeline group 20 is arranged between the discharge nozzle group 10 and the pipe collection portion 30. The discharge pipeline group 20 comprises pipelines through which the viscous material N supplied from the first supply unit 40 or the second supply unit 50 via the pipe collection portion 30 is fed to the discharge nozzle group 10.

The plurality of discharge pipeline group 20 includes a plurality of discharge pipelines 20*a* to 20*j*. The plurality of discharge pipelines 20*a* to 20*j* respectively communicate with the plurality of discharge nozzles 10*a* to 10*j* forming the discharge nozzle group 10.

The pipe collection portion 30 is arranged upstream of the discharge pipeline group 20. The pipe collection portion 30 is arranged upstream of the plurality of discharge pipelines 20*a* to 20*j*. The pipe collection portion 30 is a portion in which the plurality of discharge pipelines 20*a* to 20*j* is collected. The pipe collection portion 30 feeds the viscous material N supplied from the first supply unit 40 or the second supply unit 50 to the discharge pipeline group 20.

As shown in FIG. 2, the first supply unit 40 and the second supply unit 50 are arranged upstream of the pipe collection portion 30. The first supply unit 40 communicates with the pipe collection portion 30 through a coupling pipe 35. The second supply unit 50 communicates with the pipe collection portion 30 through a coupling pipe 36. The first supply unit 40 and the second supply unit 50 can supply the viscous material N to the discharge nozzle group 10 through the pipe collection portion 30 and the discharge pipeline group 20.

As shown in FIG. 2, the first supply unit 40 and the second supply unit 50 respectively include a first supply portion 42 and a second supply portion 52 which can supply the viscous material N to the discharge nozzle group 10, and a first switch portion 47 and a second switch portion 57. The detailed configurations of the first supply unit 40 and the second supply unit 50 will be described in detail later.

One of the first supply unit 40 and the second supply unit 50 supplies the viscous material N to the discharge nozzle group 10, based on an instruction from the control portion 100 which will be described later. One of the first supply unit 40 and the second supply unit 50 supplies the viscous material N to the discharge nozzle group 10, based on an instruction from the control portion 100 which will be described later, and the other prepares the viscous material N necessary for the subsequent time zone (coating step) where the amount of discharge (flow rate) is changed. One of the first supply unit 40 and the second supply unit 50 supplies the viscous material N to the discharge nozzle group 10, based on an instruction from the control portion 100 which will be described later, and the other supply unit is switched so as to supply the viscous material N to the discharge nozzle group 10 at the timing at which the time zone is switched to the subsequent time zone (coating step). The operation of the first supply unit 40 and the second supply unit 50, the control with the control portion 100 and the like will be described in detail later.

As shown in FIG. 2, the first supply unit 40 includes the first supply portion 42, the first switch portion 47 and a first liquid feed pipeline 71 which connects the first supply portion 42 and the first switch portion 47 together.

The first supply portion 42 includes a first piston 43, a first cylinder 44 and a motor (not shown). In the present embodiment, the first supply portion 42 is a booster-type supply portion. The first supply portion 42 is arranged so as to communicate with a supply source (not shown) of the viscous material N.

The first supply portion 42 sucks the viscous material N from the supply source by reciprocating the first piston 43 with the motor, stores (prepares) it within the first cylinder 44 and supplies the stored viscous material N to the first switch portion 47 through the first liquid feed pipeline 71.

The first supply portion 42 is configured such that by an instruction from the control portion 100, the first supply portion 42 can be changed into a supply state where the viscous material N is supplied to the side of the first switch portion 47 and into a preparatory state where the viscous material N is stored.

The first switch portion 47 is arranged between the first supply portion 42 and the pipe collection portion 30. The first switch portion 47 is formed with, for example, an electromagnetic valve, and can be opened and closed based on an instruction from the control portion 100. The first switch portion 47 is configured such that the first switch portion 47 can be switched to an opened state where the viscous material N from the first supply portion 42 is supplied to the discharge nozzle group 10, and to a closed state where the viscous material N is not supplied to the discharge nozzle group 10.

As shown in FIG. 2, the second supply unit 50 includes the second supply portion 52, the second switch portion 57 and a second liquid feed pipeline 72 which connects the second supply portion 52 and the second switch portion 57 together.

The second supply portion 52 includes a second piston 53, a second cylinder 54 and a motor (not shown). In the present embodiment, the second supply portion 52 is a booster-type supply portion. The second supply portion 52 is arranged so as to communicate with the supply source (not shown) of the viscous material N.

The second supply portion 52 sucks the viscous material N from the supply source by reciprocating the second piston 53 with the motor, stores (prepares) it within the second cylinder 54 and supplies the stored viscous material N to the second switch portion 57 through the second liquid feed pipeline 72.

The second supply portion 52 is configured such that by an instruction from the control portion 100, the second supply portion 52 can be changed into a supply state where the viscous material N is supplied to the side of the second switch portion 57, and into a preparatory state where the viscous material N is stored.

The second switch portion 57 is arranged between the second supply portion 52 and the pipe collection portion 30. The second switch portion 57 is formed with, for example, an electromagnetic valve, and can be opened and closed based on an instruction from the control portion 100. The second switch portion 57 is configured such that the second switch portion 57 can be switched to an opened state where the viscous material N from the second supply portion 52 is supplied to the discharge nozzle group 10 and to a closed state where the viscous material N is not supplied to the discharge nozzle group 10.

As shown in FIG. 3, the control portion 100 includes a first supply control portion 110, a first switch control portion 112, a second supply control portion 120, a second switch control portion 122 and a discharge nozzle control portion 130. The control portion 100 controls the supply state/the preparatory state in the first supply unit 40 and the second supply unit 50, and controls the discharge state of the discharge nozzle group 10.

The first supply control portion 110 controls the first supply portion 42. When the first supply control portion 110 brings the first supply unit 40 into the supply state, the first supply control portion 110 provides to the first supply portion 42, an instruction to start supply of the viscous material N, the supply speed (for example, the drive speed of the motor) and the supply amount (for example, the driving amount of the motor). When the first supply control portion 110 brings the first supply unit 40 into the preparatory state, the first supply control portion 110 provides to the first supply portion 42, an instruction to start suction of the viscous material N, the suction speed (for example, the drive speed of the motor) and the amount of suction (for example, the driving amount of the motor).

The first switch control portion 112 controls the first switch portion 47. When the first switch control portion 112 brings the first supply unit 40 into the supply state, the first switch control portion 112 brings the first switch portion 47 into the opened state. When the first switch control portion 112 brings the first supply unit 40 into the preparatory state, the first switch control portion 112 brings the first switch portion 47 into the closed state.

The second supply control portion 120 controls the second supply portion 52. When the second supply control portion 120 brings the second supply unit 50 into the supply state, the second supply control portion 120 provides to the second supply portion 52, an instruction to start supply of the viscous material N, the supply speed (for example, the drive speed of the motor) and the supply amount (for example, the driving amount of the motor). When the second supply control portion 120 brings the second supply unit 50 into the preparatory state, the second supply control portion 120 provides to the second supply portion 52, an instruction to start suction of the viscous material N, the suction speed (for example, the drive speed of the motor) and the amount of suction (for example, the driving amount of the motor).

The second switch control portion 122 controls the second switch portion 57. When the second switch control portion 122 brings the second supply unit 50 into the supply state, the second switch control portion 122 brings the second switch portion 57 into the opened state. When the second switch control portion 122 brings the second supply unit 50 into the preparatory state, the second switch control portion 122 brings the second switch portion 57 into the closed state.

The discharge nozzle control portion 130 controls the amount of discharge (flow rate) and a discharge pattern in the discharge nozzle group 10. The discharge nozzle control portion 130 controls the opening and closing of the plurality of discharge nozzles 10*a* to 10*j* forming the discharge nozzle group 10. Specifically, the discharge nozzle control portion 130 controls the open/close valves 11*a* to 11*j* so as to control the opening and closing of the plurality of discharge nozzles 10*a* to 10*j*.

As described above, the control portion 100 controls the supply state/the preparatory state in the first supply unit 40 and the second supply unit 50. Specifically, at the timing at which a coating pattern or the amount of discharge (flow rate) is varied, the control portion 100 brings one of them into the supply state and brings the other into the preparatory state. The control portion 100 performs control as below when, for example, a first time zone, a second time zone, a third time zone and the subsequent time zones where the amounts of discharge (flow rate) of the viscous material N discharged from the discharge nozzle group 10 differ from each other are continuous. Here, in the first time zone, for example, as shown in FIG. 4(*a*), in the discharge nozzle group 10, the viscous material N is discharged from all the discharge nozzles 10*a* to 10*j*. In the second time zone, for example, as shown in FIG. 4(*b*), in the discharge nozzle group 10, the viscous material N is discharged from the discharge nozzles 10*d*, 10*e*, 10*h* and 10*i*. In the second time zone, for example, as shown in FIG. 4(*c*), in the discharge nozzle group 10, the viscous material N is also discharged from the discharge nozzles 10*a* to 10*d* and 10*f* to 10*i*.

In the first time zone, the control portion 100 makes the first supply unit 40 that is the supply unit which completes the preparation of the viscous material N necessary in the first time zone discharge the viscous material N to the discharge nozzle group 10 at a first flow rate, and makes the second supply unit 50 prepare the viscous material N necessary in the second time zone. Specifically, in the first time zone, the control portion 100 makes the first supply portion 42 supply the viscous material N to the discharge nozzle group 10 at the first flow rate, and brings the first switch portion 47 into the opened state. Furthermore, the control portion 100 brings the second switch portion 57 into the closed state, and makes the second supply portion 52 suck the viscous material N such that the second supply portion 52 stores, in the first time zone, the viscous material N which is supplied (discharged) in the second time zone.

Then, at the timing at which the first time zone is switched to the second time zone, the control portion 100 stops the supply in the first supply unit 40, and makes the second supply unit 50 that completes the preparation of the viscous material N supplied in the second time zone, start the supply of the viscous material N to the discharge nozzle group 10 at a second flow rate. Specifically, at the timing at which the first time zone is switched to the second time zone, the control portion 100 makes the first supply portion 42 stop the supply of the viscous material N, and brings the first switch portion 47 into the closed state. Furthermore, the control portion 100 makes the second supply portion 52 supply the viscous material N to the discharge nozzle group 10 at the second flow rate, and brings the second switch portion 57 into the opened state.

Then, in the second time zone, the control portion 100 makes the second supply unit 50 supply the viscous material N at the second flow rate, and makes the second supply unit 50 prepare the viscous material N necessary in the third time zone. Specifically, in the second time zone, the control portion 100 makes the second supply portion 52 supply the viscous material N to the discharge nozzle group 10 at the second flow rate, and keeps the second switch portion 57 in the opened state. Furthermore, the control portion 100 brings the first switch portion 47 into the closed state, and makes the first supply portion 42 suck the viscous material N such that the first supply portion 42 stores, in the second time zone, the viscous material N which is supplied (discharged) in the third time zone.

Then, at the timing at which the second time zone is switched to the third time zone, the control portion 100 performs the same control as the control at the timing at which the first time zone is switched to the second time zone. In the third time zone, the control portion 100 also performs the same control as the control in the first time zone.

Here, when the amount of variation in the supply amount (amount of discharge) is less than a predetermined amount, the control portion 100 can also ensure that the supply unit to be used is not changed. For example, when the amount of variation that is a difference between the flow rate of the viscous material N supplied to the discharge nozzle group 10 in a predetermined time zone and the flow rate of the viscous material N supplied to the discharge nozzle group 10 in a time zone continuous with the predetermined time zone is less than the predetermined amount, the control portion 100 makes the supply unit that supplies the viscous material in the predetermined time zone supply the viscous material continuously even in the continuous time zone. For example, when a coating state (discharge state) in the first time zone (see FIG. 4(*a*)) is switched to a coating state (discharge state) in the third time zone (see FIG. 4(*c*)), since a small amount of variation in the viscous material N is produced, the control portion 100 can perform control such that the first supply unit 40 is kept in the supply state.

Figure 5:
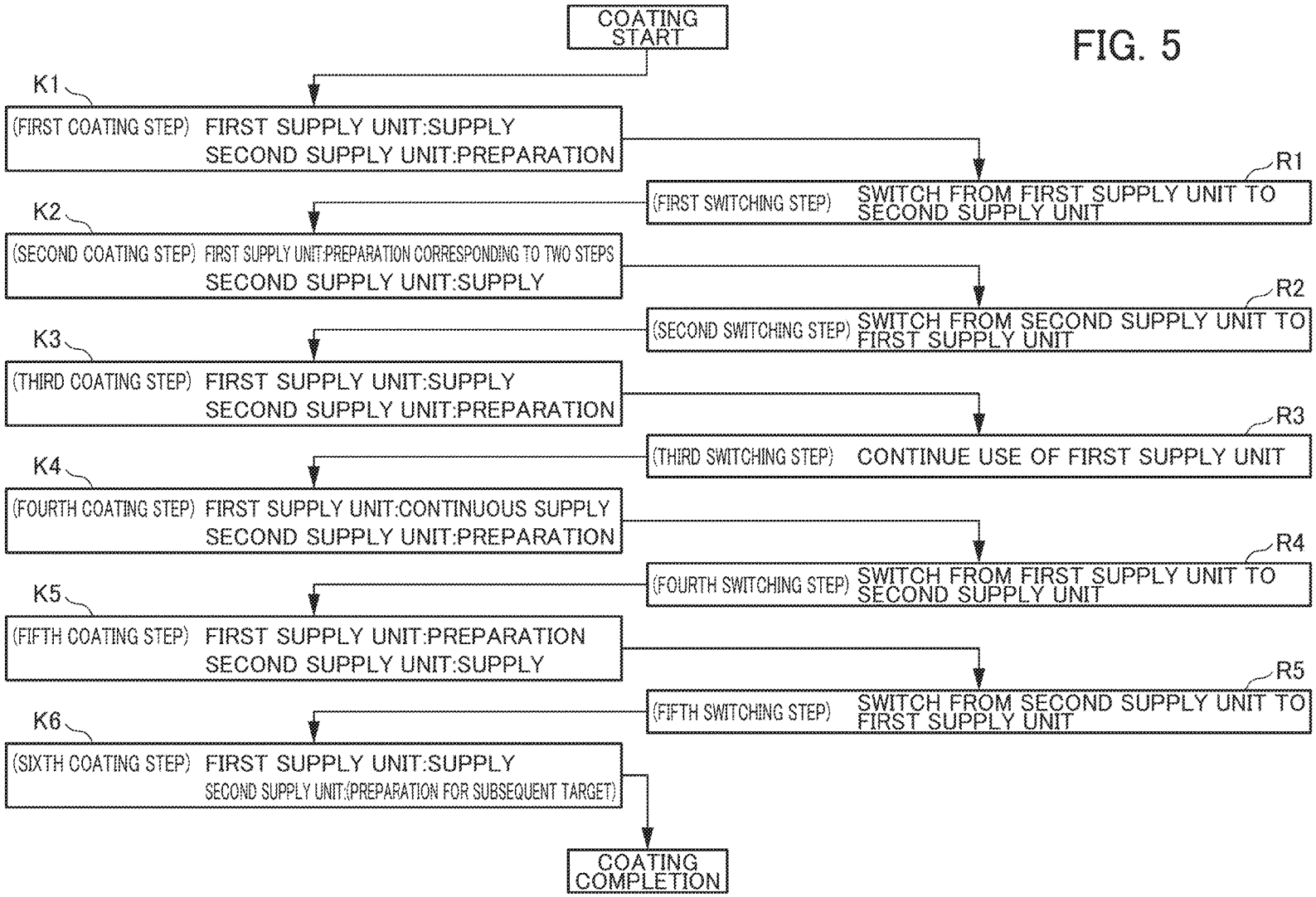
FIG. 5 is a flow diagram illustrating the operation of the coating device according to the embodiment of the present invention.
Figure 6:
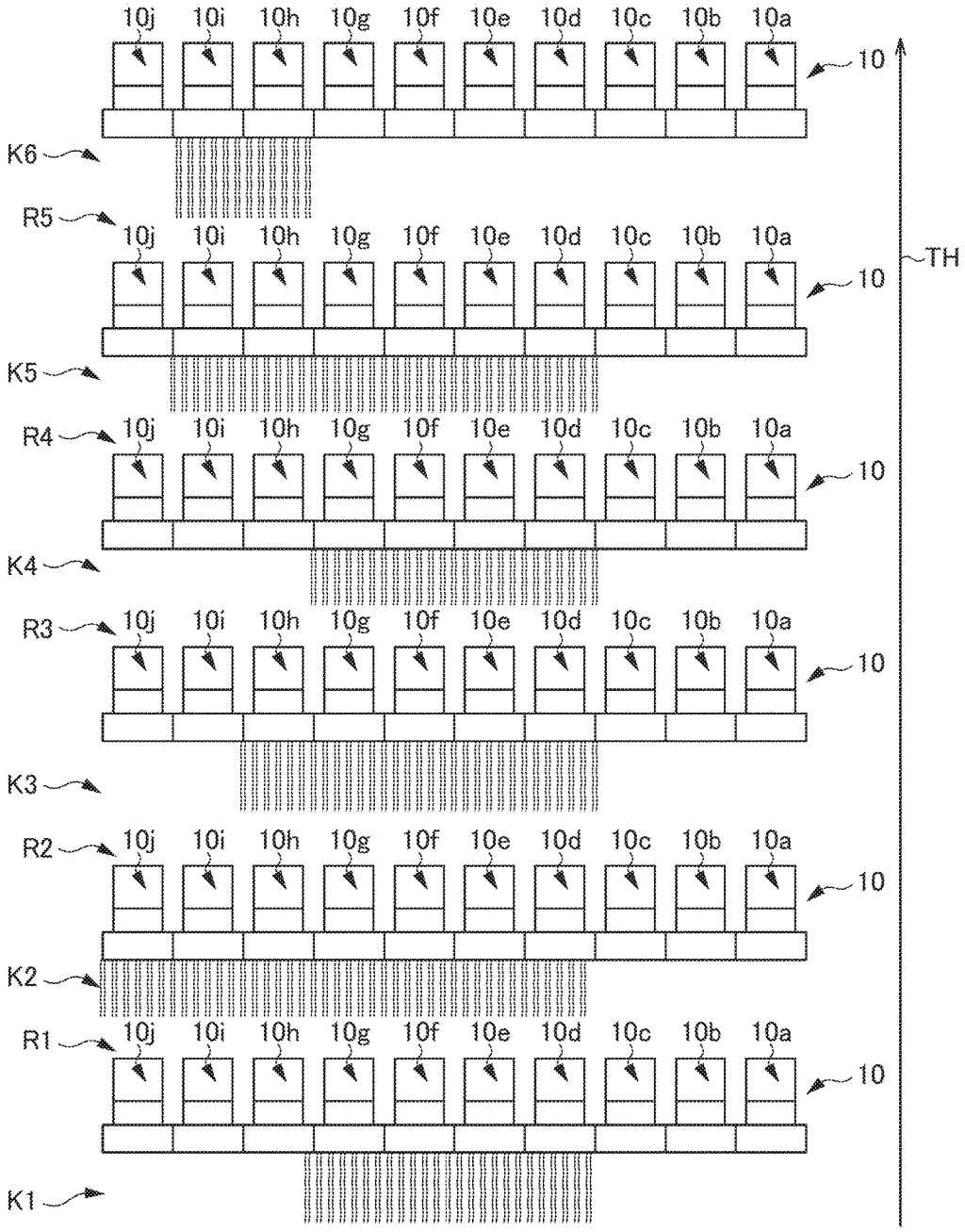
FIG. 6 is a schematic diagram illustrating the operation of the coating device according to the embodiment of the present invention.
Figure 7:
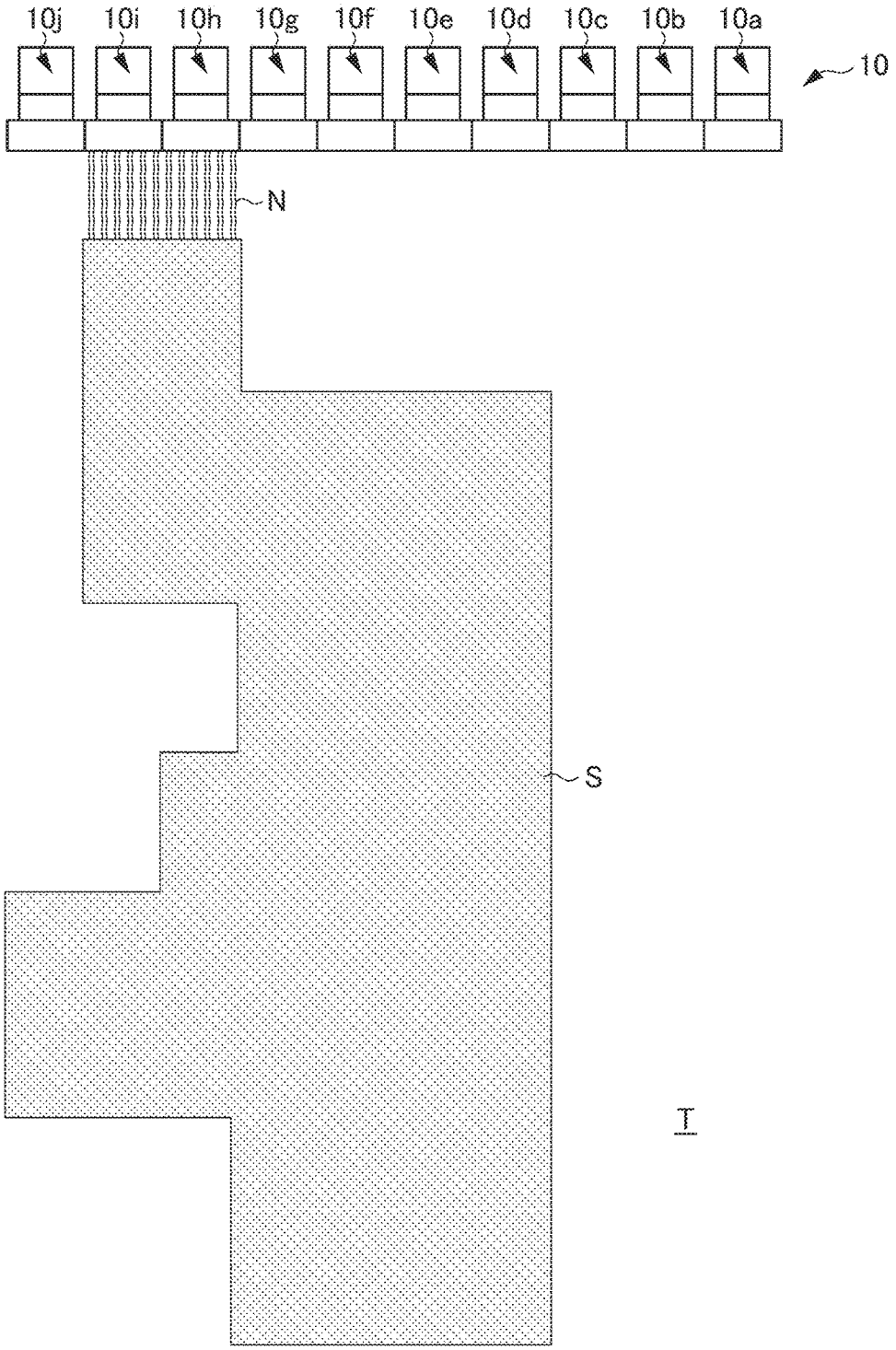
FIG. 7 is a diagram showing a vibration damping material portion formed with the coating device according to the embodiment of the present invention.

The operation of the coating device 1 will then be described with reference to FIGS. 5 to 7. FIG. 5 is a flow diagram illustrating the operation of the coating device according to the embodiment of the present invention. FIG. 6 is a schematic diagram illustrating the operation of the coating device according to the embodiment of the present invention. FIG. 7 is a diagram showing a vibration damping material portion formed with the coating device according to the embodiment of the present invention.

As shown in FIGS. 5 to 7, the coating (formation of the vibration damping material portion S) of the target T with the viscous material N by the coating device 1 is performed by alternately performing a plurality of coating steps and a plurality of switching steps. The coating device 1 switches the supply state/the preparatory state in the first supply unit 40 and the second supply unit 50 while moving the discharge nozzle group 10 in a coating direction TH, and controls the opening and closing of the plurality of discharge nozzles 10*a* to 10*j* so as to coat (discharge) a necessary region with the viscous material N.

As shown in FIGS. 5 and 6, in a first coating step K1, the coating device 1 brings the first supply unit 40 into the supply state and brings the second supply unit 50 into the preparatory state. The coating device 1 makes the first supply unit 40 supply the viscous material N to the discharge nozzle group 10 at the first flow rate. The coating device 1 makes the second supply unit 50 prepare such that the viscous material N used in a second coating step K2 is completed in the first coating step K1. Then, the coating device 1 makes the discharge nozzles 10*d* to 10*g* in the discharge nozzle group 10 discharge the viscous material N.

Then, in a first switching step R1, the coating device 1 switches the supply unit that supplies the viscous material N from the first supply unit 40 to the second supply unit 50. At the timing at which the first coating step K1 is switched to the second coating step K2, the coating device 1 stops the supply in the first supply unit 40 and makes the second supply unit 50 start the supply of the viscous material N to the discharge nozzle group 10 at the second flow rate.

Then, in the second coating step K2, the coating device 1 brings the first supply unit 40 into the preparatory state (which corresponds to two coating steps), and brings the second supply unit 50 into the supply state. The coating device 1 makes the second supply unit 50 supply the viscous material N at the second flow rate. The coating device 1 makes the first supply unit 40 prepare such that the viscous material necessary in a third coating step K3 and a fourth coating step K4 is completed in the second coating step K2. Since the amount of variation in the difference between a third flow rate of the viscous material N in the third coating step K3 and a fourth flow rate of the viscous material N in the fourth coating step K4 is less than a predetermined amount (in the present embodiment, variation which corresponds to two discharge nozzles is assumed to be the predetermined amount), the coating device 1 brings the first supply unit 40 that is in the supply state in the third coating step K3 into the supply state continuously even in the fourth coating step K4. As such, in the second coating step K2, the coating device 1 prepares the viscous material necessary in the third coating step K3 and the fourth coating step K4. Then, the coating device 1 makes the discharge nozzles 10*d* to 10*j* in the discharge nozzle group 10 discharge the viscous material N.

Then, in a second switching step R2, the coating device 1 switches the supply unit that supplies the viscous material N from the second supply unit 50 to the first supply unit 40. At the timing at which the second coating step K2 is switched to the third coating step K3, the coating device 1 stops the supply in the second supply unit 50, and makes the first supply unit 40 start the supply of the viscous material N to the discharge nozzle group 10 at the third flow rate.

Then, in the third coating step K3, the coating device 1 brings the first supply unit 40 into the supply state, and brings the second supply unit 50 into the preparatory state. The coating device 1 makes the first supply unit 40 supply the viscous material N to the discharge nozzle group 10 at the third flow rate. The coating device 1 makes the second supply unit 50 prepare such that the viscous material N used in a fifth coating step K5 is completed in the third coating step K3 and the fourth coating step K4. Then, the coating device 1 makes the discharge nozzles 10*d* to 10*h* in the discharge nozzle group 10 discharge the viscous material N.

Then, in a third switching step R3, the coating device 1 continuously uses the first supply unit 40 as the supply unit which supplies the viscous material N. Since the amount of variation that is a difference between the flow rate (third flow rate) of the viscous material N supplied to the discharge nozzle group 10 in the third coating step K3 (the third time zone) and the flow rate (fourth flow rate) of the viscous material N supplied to the discharge nozzle group 10 in the fourth coating step K4 (the fourth time zone) is less than a predetermined amount, the coating device 1 (the control portion 100) makes the first supply unit that supplies the viscous material N in the third coating step K3 (the third time zone) supply the viscous material N continuously even in the fourth coating step K4 (the fourth time zone). Here, although in the present embodiment, the predetermined amount is set to the amount of discharge (flow rate) which corresponds to two discharge nozzles, there is no limitation on this configuration, and the predetermined amount can be set as necessary. The coating device 1 (the control portion 100) determines, from, for example, information on the flow rate included in various types of instruction information input to the control portion 100, whether or not the amount of variation is less than the predetermined amount.

Then, in the fourth coating step K4, the coating device 1 keeps the first supply unit 40 in the supply state, and keeps the second supply unit 50 in the preparatory state. The coating device 1 changes the flow rate of the viscous material N from the third flow rate to the fourth flow rate without changing the supply unit used. The coating device 1 makes the first supply unit 40 supply the viscous material N to the discharge nozzle group 10 at the fourth flow rate. The coating device 1 makes the second supply unit 50 prepare such that the viscous material N used in the fifth coating step K5 is completed in (the third coating step K3 in addition to) the fourth coating step K4. Then, the coating device 1 makes the discharge nozzles 10*d* to 10*g* in the discharge nozzle group 10 discharge the viscous material N.

Then, in a fourth switching step R4, the coating device 1 switches the supply unit that supplies the viscous material N from the first supply unit 40 to the second supply unit 50. At the timing at which the fourth coating step K4 is switched to the fifth coating step K5, the coating device 1 stops the supply in the first supply unit 40, and makes the second supply unit 50 start the supply of the viscous material N to the discharge nozzle group 10 at the fifth flow rate.

Then, in the fifth coating step K5, the coating device 1 brings the first supply unit 40 into the preparatory state, and brings the second supply unit 50 into the supply state. The coating device 1 makes the second supply unit 50 supply the viscous material N to the discharge nozzle group 10 at the fifth flow rate. The coating device 1 makes the first supply unit 40 prepare such that the viscous material N used in a sixth coating step K6 is completed in the fifth coating step K5. Then, the coating device 1 makes the discharge nozzles 10*d* to 10*i* in the discharge nozzle group 10 discharge the viscous material N.

Then, in a fifth switching step R5, the coating device 1 switches the supply unit that supplies the viscous material N from the second supply unit 50, to the first supply unit 40. At the timing at which the fifth coating step K5 is switched to the sixth coating step K6, the coating device 1 stops the supply in the second supply unit 50, and makes the first supply unit 40 start the supply of the viscous material N to the discharge nozzle group 10 at a sixth flow rate.

Then, in the sixth coating step K6, the coating device 1 brings the first supply unit 40 into the supply state. The coating device 1 makes the first supply unit 40 supply the viscous material N to the discharge nozzle group 10 at the sixth flow rate. Then, the coating device 1 makes the discharge nozzles 10*h* and 10*i* discharge the viscous material N. The coating device 1 can also make the second supply unit 50 prepare the viscous material N used in the first coating step for the subsequent target T.

As shown in FIG. 7, the coating device 1 coats the target T with the viscous material N as described above, and thereby can form the vibration damping material portion S. In the present embodiment, as the viscous material N, a material whose main component is a resin is used. Examples of the resin include emulsion resins such as SBR vinyl acetate, asphalt and acrylic resin.

In the present embodiment, the following effects are produced.

In the present embodiment, at the timing at which the first time zone (the first coating step) is switched to the second time zone (the second coating step), the coating device 1 stops the supply of the viscous material N at the first flow rate by the first supply unit 40, and starts the supply of the viscous material N at the second flow rate by the second supply unit 50. In this way, the coating device 1 can reduce variation in the amount of discharge of the viscous material N at the time of change to a time zone (coating step) where the flow rate is different. In this way, the coating device 1 can reduce variation in the thickness of coating in a portion (for example, a position in which the width is changed) in which the shape of the coated region is changed.

In the present embodiment, the coating device 1 includes a plurality of discharge nozzles having the open/close valves, and includes the discharge nozzle group 10 in which the plurality of discharge nozzles 10*a* to 10*j* are arranged so as to be aligned. In this way, the coating device 1 can coat the coated region with the viscous material N without reciprocating the discharge nozzle portion a plurality of times. In this way, the coating device 1 can also shorten the time during which the viscous material N is applied. In this way, the coating device 1 can also enhance the production efficiency.

In the present embodiment, the coating device 1 makes one of the first supply unit 40 and the second supply unit 50 supply the viscous material N, and makes the other start (complete) the preparation of the viscous material necessary in the subsequent time zone (coating step). In this way, each time the time zone (coating step) is changed, the coating device 1 can use (switch) the first supply unit 40 or the second supply unit 50 which completes the preparation (storage) of the viscous material N.

In the present embodiment, at the timing at which the first time zone is switched to the second time zone, the coating device 1 makes the first supply portion 42 stop the supply of the viscous material N, brings the second switch portion 57 into the closed state, makes the second supply portion 52 supply the viscous material N to the discharge nozzle group 10 at the second flow rate and brings the second switch portion 57 into the opened state. In this way, the coating device 1 can suitably reduce variation in the amount of discharge of the viscous material N at the time of change to a time zone where the flow rate is different. In this way, the coating device 1 can also suitably reduce variation in the thickness of coating in a portion (for example, a position in which the width is changed) in which the shape of the coated region is changed.

In the present embodiment, when the amount of variation, that is, the difference between the flow rate of the viscous material N supplied to the discharge nozzle group 10 in a predetermined time zone and the flow rate of the viscous material N supplied to the discharge nozzle group 10 in a time zone continuous with the predetermined time zone, is less than the predetermined amount, the coating device 1 makes the supply unit that supplies the viscous material in the predetermined time zone supply the viscous material continuously, even in the continuous time zone. In this way, when a small amount of variation in the supply amount of the viscous material N caused by the change of the time zones (coating steps) is produced, the coating device 1 can continuously make the same supply unit supply the viscous material. In this way, the coating device 1 can reduce the excessive switching of the supply units, and thereby can reduce a burden placed on the device.

The present invention is not limited to the embodiment described above, and variations, modifications and the like which can achieve the object of the present invention are included in the present invention.

Although in the present embodiment, the coating device 1 includes the two supply units, there is no limitation on this configuration, and the coating device 1 may include three or more supply units. In such a case, in the first time zone, the coating device 1 makes the predetermined supply unit among a plurality of supply units that completes the preparation of the viscous material in the first time zone, supply the viscous material to the discharge nozzle group 10 at the first flow rate. At the timing at which the first time zone is switched to the second time zone, the coating device 1 stops the supply in the predetermined supply unit, and makes another supply unit among the plurality of supply units that completes the preparation of the viscous material supplied in the second time zone start the supply of the viscous material at the second flow rate. Then, in the second time zone, the coating device 1 makes the another supply unit supply the viscous material at the second flow rate, and makes the predetermined supply unit start the preparation of the viscous material necessary in any one of the third time zone and the subsequent time zones. Here, the coating device 1 makes the predetermined supply unit start the preparation of the viscous material necessary in any one of the third time zone and the subsequent time zones so as to complete the preparation by any one of the time zones.

Although in the present embodiment, the discharge nozzle group 10 includes the 10 discharge nozzles, there is no limitation on this configuration, and the number of discharge nozzles may be less than 10 or more than 10. The number of discharge nozzles forming the discharge nozzle group 10 can be freely set according to the area of the coated region in the target (for example, the body of an automobile) and the required accuracy of discharge.

Although in the present embodiment, the coating device 1 includes the one discharge nozzle group, there is no limitation on this configuration, and the coating device 1 may include a plurality of discharge nozzle groups. In this case, the coating device 1 preferably includes a plurality of supply units for each of the discharge nozzle groups.

Although in the present embodiment, the viscous material is the vibration damping material having sound-proof and vibration-proof functions, there is no limitation on this configuration, and the viscous material may be a paint, an adhesive or the like.

EXPLANATION OF REFERENCE NUMERALS

1: coating device
2: articulated robot
10: discharge nozzle group
10*a* to 10*j*: discharge nozzle
20: discharge pipeline group
20*a* to 20*j*: discharge pipeline
30: pipe collection portion
40: first supply unit
42: first supply portion
47: first switch portion
50: second supply unit
52: second supply portion

57: second switch portion
100: control portion
N: viscous material
S: vibration damping material portion
T: target

What is claimed is:

1. A coating device comprising:

a discharge nozzle group which includes a plurality of discharge nozzles having open/close valves and in which the plurality of discharge nozzles are arranged so as to be aligned;

a pipe collection portion which is arranged on an upstream side of a plurality of discharge pipelines that respectively communicate with the plurality of discharge nozzles forming the discharge nozzle group and in which the plurality of pipelines are collected;

a plurality of supply units which are arranged on an upstream side of the pipe collection portion and which can supply a viscous material to the discharge nozzle group;

a switch portion which is arranged between a supply portion and the pipe collection portion and which can switch between an opened state where the viscous material from the supply portion is supplied to the discharge nozzle group and a closed state where the viscous material is not supplied to the discharge nozzle group; and a control portion which operates with respect to a first time zone, a second time zone, a third time zone and subsequent time zones, wherein for respective time zones, flow rates of the viscous material discharged from the discharge nozzle group differ from each other and wherein respective time zones are continuous, the control portion makes, in the first time zone, a predetermined supply unit among the plurality of supply units supply the viscous material to the discharge nozzle group at a first flow rate, wherein the predetermined supply unit completes preparation of the viscous material in the first time zone, stops, at a timing at which the first time zone is switched to the second time zone, the supply in the predetermined supply unit and makes another supply unit among the plurality of supply units that completes a preparation of the viscous material supplied in the second time zone, start the supply of the viscous material to the discharge nozzle group at a second flow rate and makes, in the second time zone, the another supply unit supply the viscous material at the second flow rate and makes the predetermined supply unit start a preparation of the viscous material necessary in any one of the third time zone and the subsequent time zones.

2. The coating device according to claim 1, wherein each of the plurality of supply units includes:

the supply portion which can supply the viscous material to the discharge nozzle group; and the control portion in the first time zone, makes the supply portion in the predetermined supply unit supply the viscous material to the discharge nozzle group at the first flow rate, and brings the switch portion in the predetermined supply unit into the opened state, with the timing at which the first time zone is switched to the second time zone, makes the supply portion in the predetermined supply unit stop the supply of the viscous material, brings the switch portion in the predetermined supply unit into the closed state, makes the supply portion in the another supply unit supply the viscous material to the discharge nozzle group at the second flow rate and brings the switch portion in the another supply unit into the opened state and in the second time zone, makes the supply portion in the another supply unit supply the viscous material to the discharge nozzle group at the second flow rate, keeps the switch portion in the another supply unit in the opened state and makes the supply portion in the predetermined supply unit start a preparation of the viscous material necessary in any one of the third time zone and the subsequent time zones.

3. The coating device according to claim 1, wherein when an amount of variation, that is, the difference between a flow rate of the viscous material supplied to the discharge nozzle group in a predetermined time zone, and a flow rate of the viscous material supplied to the discharge nozzle group in a time zone continuous with the predetermined time zone, is less than a predetermined amount, the control portion makes a supply unit that supplies the viscous material in the predetermined time zone supply the viscous material continuously even in a continuous time zone.

4. The coating device according to claim 2, wherein when an amount of variation, that is, the difference between a flow rate of the viscous material supplied to the discharge nozzle group in a predetermined time zone, and a flow rate of the viscous material supplied to the discharge nozzle group in a time zone continuous with the predetermined time zone, is less than a predetermined amount, the control portion makes a supply unit that supplies the viscous material in the predetermined time zone supply the viscous material continuously even in a continuous time zone.

* * * * *